United States Patent [19]

Gernhardt et al.

[11] Patent Number: 4,630,015

[45] Date of Patent: Dec. 16, 1986

[54] GROUND FAULT CIRCUIT INTERRUPTER

[75] Inventors: Paul D. Gernhardt, Northport; Ferdinand E. Orbeta, Kew Gardens, both of N.Y.

[73] Assignee: Slater Electric, Inc., Glen Cove, N.Y.

[21] Appl. No.: 690,119

[22] Filed: Jan. 10, 1985

[51] Int. Cl.[4] ..... H01H 73/00

[52] U.S. Cl. ..... 335/18; 361/356; 200/284

[58] Field of Search ..... 335/18, 189, 190; 361/42, 44, 45, 356, 334; 200/246, 283, 284

[56] References Cited

U.S. PATENT DOCUMENTS

| | | | |
|---|---|---|---|
| 2,233,124 | 2/1941 | Farnas | 200/284 X |
| 3,813,579 | 5/1974 | Doyle et al. | 361/46 |
| 3,931,601 | 1/1976 | Anderson | 335/18 |
| 4,086,549 | 4/1978 | Slater et al. | 335/18 |
| 4,247,840 | 1/1981 | Cooper et al. | 335/18 |
| 4,386,338 | 5/1983 | Doyle et al. | 340/310 A |
| 4,521,824 | 6/1985 | Morris et al. | 335/18 X |

*Primary Examiner*—L. T. Hix
*Assistant Examiner*—Brian W. Brown
*Attorney, Agent, or Firm*—Morgan & Finnegan

[57] ABSTRACT

In a ground fault circuit interrupter (GFCI), a pair of flexure arms having moveable contacts disposed thereon are deflected in response to the activation of a solenoid having a moveable core. The core of the solenoid causes a pair of cam actuators which are preferably coupled together by a catcher to rotate. The rotation of the cam actuators causes the deflection of the flexure arms, thereby separating the moveable contacts from the stationary contacts and interrupting the flow of current. The activation of the solenoid is controlled by an electronic module. The electromechanical current interrupter and the electronic module are disposed within a housing that can be mounted within a standard electrical receptacle box.

19 Claims, 16 Drawing Figures

GROUND FAULT CIRCUIT INTERRUPTER

BACKGROUND OF THE INVENTION

1. Field of the Invention

The apparatus of the present invention relates to electrical power distribution systems, and more specifically to a ground fault circuit interrupter.

2. Description of the Prior Art

Ground fault circuit interrupters (GFCI) are devices which are mounted in standard electrical receptacle boxes and which are useful for quickly interrupting the flow of current when a fault occurs. The ground fault circuit interrupter is typically comprised of an electronic circuit for detecting the electrical fault and an electromechanical current interrupter. When the cause of the fault has been corrected, the ground fault circuit interrupter can be reset by depressing a reset button disposed on the face of the ground fault interrupter. A representative example of such a device is described in U.S. Pat. No. 3,813,579 by Doyle et al., issued on May 28, 1974.

There are several other patents which disclose ground fault circuit interrupters. The electromechanical current interrupter of these devices, however, can be characterized as an electromechanical device utilizing either a moving core and helical coil as the power element or as an electromechanical device utilizing a fixed core, helical coil and an armature as the power element. A typical example of a ground fault circuit interrupter device having a moving core which opens spring actuated contacts is disclosed in U.S. Pat. No. 4,247,840, Cooper et al., issued Jan. 21, 1981 and assigned to GTE. A typical example of a ground fault interrupter device having a fixed core which opens spring actuated contacts is disclosed in U.S. Pat. No. 4,086,549, issued Apr. 25, 1978 to assignee of the present invention.

Since the electromechanical current interrupter device of a ground fault interrupter is disposed inside a standard electrical receptacle box, space is at a premium and it is difficult to design a reliable device having good mechanical leverage to open a pair of contacts. An approach to a similiar problem is disclosed in U.S. Pat. No. 4,386,338 by Doyle et al. issued May 31, 1983 and assigned to Leviton Manufacturing Co. The apparatus of the '338 patent is a remote control device which includes a pair of contacts disposed upon a pair of members which are displaced by a flip-flop cam arrangement that is actuated by a solenoid having a moving coil. The apparatus of the '338 patent is similar to an impulse latching relay such as the Potter & Brimfield type PC (manufactured approximately 1955–1975) but utilizes a pulling solenoid actuation instead of a relay. The solenoid mechanism is complex and the arm opening mechanism has high friction and has a poor mechanical advantage so that a bulky coil is required to actuate the mechanism.

Accordingly, there is a need for a reliable electromechanical current interrupter device for a ground fault circuit interrupter which can directly utilize the kinetic energy of the moving core of a solenoid. The present invention, therefore, is unique among ground fault current interrupters, since it applies the operating force of the solenoid to open the contacts and does not rely upon manually set springs to perform this function.

SUMMARY OF THE INVENTION

The apparatus of the present invention provides a reliable electromechanical current interrupter device for a ground fault circuit interrupter which applies the operating force of a solenoid to open the contacts and which can be packaged for mounting in a standard electrical receptacle box. The device includes an electromagnetic coil or solenoid having a moveable core, and two pivot arms or cam actuators which are coupled together by gears and a catcher and which rotate when the moveable core displaces the catcher. As the cam actuators rotate, they cause a pair of flexure arms having moveable contacts disposed thereon to deflect. The deflection of the flexure arms causes an opening between stationary contacts and the moveable contacts on each of the flexure arms. The electromagnetic coil is energized and the contacts are opened when an electronic circuit detects a fault in the conducting wires connected to the ground fault circuit interrupter.

BRIEF DESCRIPTION OF THE DRAWINGS

Figures llA and llB illustrate the device for securing conducting wires to the device of FIG. 1.

DETAILED DESCRIPTION OF THE INVENTION

Figure 1:
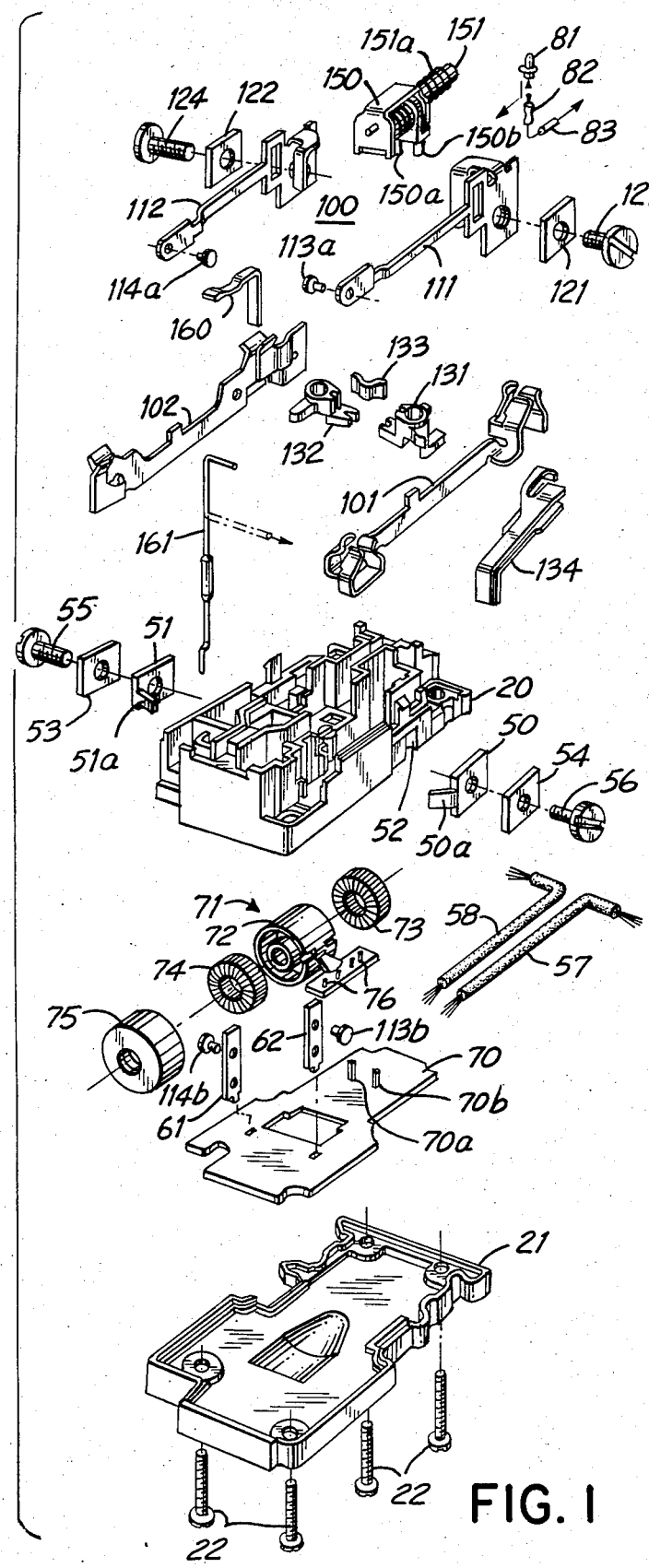
FIGS. 1 and 2 are exploded perspective views of the apparatus of the present invention.
Figure 2:
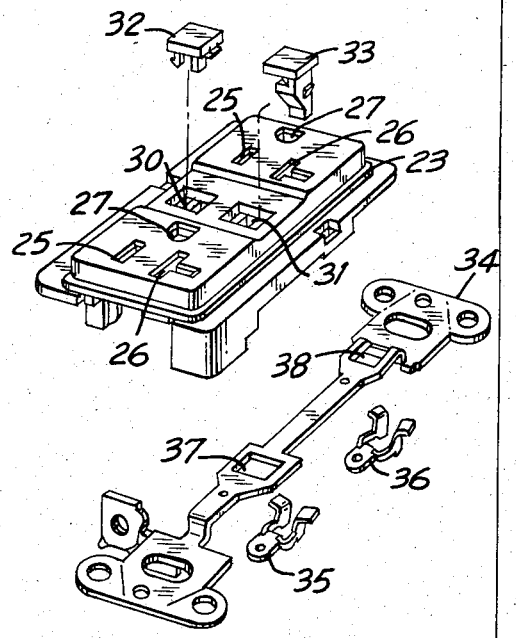

Referring now to FIGS. 1 and 2, exploded perspective views of the apparatus of the present invention are provided. The present invention includes a ground fault circuit interrupter (GFCI) which is disposed in a housing 20. The housing 20 encloses a current interrupter 100. The bottom of the housing 20 is sealed by a back cover 21 that encloses a printed circuit board 70 and its associated electronics. The back cover 21 is fastened to the face cover.23 through the housing 20 by a plurality of screws 22. The top of the housing 20 is sealed by a face cover 23 of FIG. 2.

The face cover 23 has two sets of apertures 25, 26, 27 for a standard three blade plug as well as apertures 30, 31 for a test button 32 and a reset button 33. A mounting strap 34 is disposed between the face cover 23 and the housing 20. A pair of ground terminals 35, 36 are disposed in apertures 37, 38 and cooperate with the ground blade of a three blade plug which may be seated in either of the apertures 27.

The printed circuit board 70 has a transformer 71 mounted thereon. The transformer 71 is comprised of a housing 72, a neutral transformer 73, a differential transformer 74, and a transformer cup 75. The electrical connections between the printed circuit 70 and the transformer 71 are provided by pin terminals 76.

The housing 20 also includes a neutral supply terminal 50 and a line supply terminal 51 which are seated in grooves 52 found on opposite sides of the housing 20. Optional pressure pads 53, 54 which secure external conducting wires (not shown) to the terminals 50, 51 are fastened to the terminals by screws 55, 56. A pair of shunt wires 57, 58 are welded to tails 50*a*, 51*a* on terminals 50, 51 respectively and are connected to stationary terminals 61, 62. The shunt wires 57, 58 pass through the transformer assembly 71. The stationary terminals 61, 62, which include stationary contacts 114*b*, 113*b*, are attached to the printed circuit board 70.

The housing 20 provides support for a neutral receptacle terminal 101 and a line receptacle terminal 102 which are disposed in operative relationship to neutral moveable terminal 111 and a line moveable terminal 112, respectively. The neutral moveable terminal 111 and the line moveable terminal 112 each include a respective contact 113*a*, 114*a*. Pressure pads 121, 122 are optionally affixed to the neutral moveable terminal 111 and line moveable terminal 112 by screws 123, 124. The neutral moveable terminal 111 and the line moveable terminal 112 are deflected by a neutral cam actuator 131 and a line cam actuator 132. A moveable core catcher 133 bridges between the cam actuators 131, 132 and is responsive to the displacement of the moveable core 151 of a solenoid 150. To permit a very shallow depth for the housing 20, the actuating solenoid 150 is placed in a position acting parallel to and immediately behind the face cover 23. The solenoid 150 includes sockets 150*a*, 150*b* which are connected to pins 70*a*, 70*b* on printed circuit board 70.

A test spring 160 that is responsive to the depression of the test button 32 is disposed within the housing 20. The test spring and the test resistor 161 provide an electrical path between the line load side receptacle terminal 102 and the neutral supply terminal 50 in order to simulate a relatively low level ground fault of approximately 8 ma. The present invention also may include a LED light 81, a resistor 82, and a diode 83 (or equivalent) for providing a visual indication that the contacts 113, 114 are closed.

The housing 20 also includes a spring or latching mechanism 134 hereinafter described in greater detail in conjunction with FIG. 4.

Figure 3:
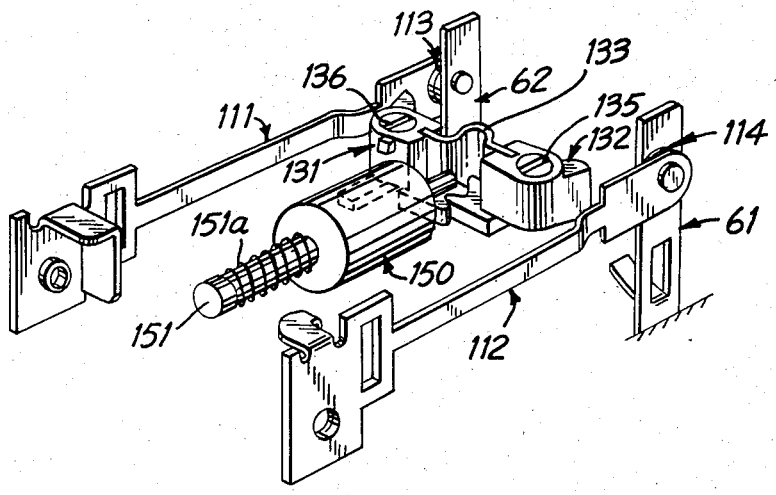
FIG. 3 is a schematic illustration of the electromechanical current interrupter device used to open a pair of contacts.

Referring now to FIG. 3, a schematic illustration of the electromechanical current interrupter 100 is provided. The current interrupter 100 includes current carrying flexure arms 11, 112 having electrical contacts 113, 114 on one end and the other end of each flexure arm, is rigidly mounted in the plastic wiring device housing 20. The solenoid coil 150 is rigidly affixed to the housing 20 and has a moveable core 151 within it. The solenoid 150 also includes a return spring 151*a*. When energized the core 151 moves against the metal catcher piece 133, moving it away from the coil of solenoid 150. As the catcher 133 moves it carries with it the plastic pivoting arms or cam actuators 131, 132. The cam actuators 131, 132 pivot about the bosses 135, 136 which are rigid parts of the housing 20. The cam actuator 132 pivots in a clockwise direction and cam actuator 131 pivots in a counter clockwise direction. As the cam actuators 131, 132 rotate they contact flexure arms 111, 112 and cause them to move away from the stationary terminals 61, 62, thus opening contacts 113, 114. This is the means by which the line and neutral supply entering through stationary terminals 61, 62 is separated from the load lines attached to the flexure arms 111, 112.

Figure 4:
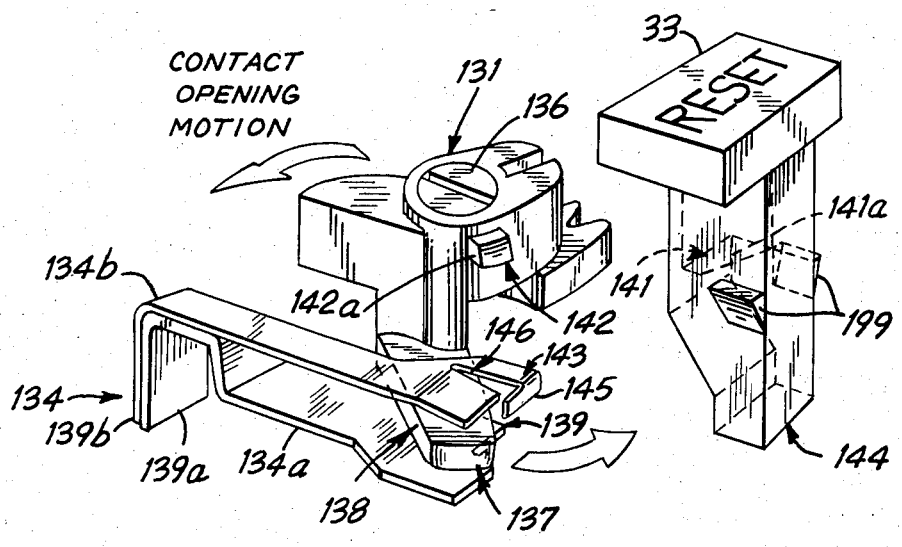
FIG. 4 is an illustration of the reset and latching mechanism of the present invention.

Referring now to FIG. 4, an illustration of the latching mechanism 134 is provided. The latching mechanism 134 may be a single piece double latching metal spring or a two piece spring which operates in conjunction with the pivoting cam actuator 131 and reset button 33 to hold the contacts 113, 114 open after a fault actuates it and until the reset button 33 is manually pushed. Preferably, the latching mechanism is comprised of spring members 134*a* and 134*b*. The joining tails 139*a*, 139*b* of the spring members 134*a*, 134*b* are inserted into a receiving hole in the middle housing 20. This two member arrangement simplifies the assembly of the device.

When the pivoting cam actuator 131 is rotated, an extension 137 moves as a part of it to a position where the trailing edge 138 of extension 137 passes beyond the edge 139 of spring member 134*a* allowing the edge 139 to move upward behind edge 138, thereby holding cam actuator 131 in the "contact open" position. The reset button 33 rests its surface 141 against surface 142 of cam 131 when the contacts 113 are closed and reset button 33 is flush with the face cover 23. However, when the cam 131 rotates to open the contacts 113 the surface 142 moves off of surface 141 and allows reset button 33 to move upward and behind the trailing edge of surface 142 in response to the upward push of portion 143 of the spring member 134*b* against the surface 144 of reset button 33. Thus, the edge 139 holds the extension 137 in the contact open position, but the corner 141*a* also is capable of holding edge 142*a* if edge 139 and extension 137 should fail. Detents 199 limit the upward motion of 33 in face 23.

To reset the contacts 113, 114 the reset button 33 is manually pushed down such that surface 144 pushes the surface 143 of the spring member 134*b* and moves it downward (corner 141*a* also clears edge 142*a*). It should be noted that surface 143 of the latching mechanism 134 is always in contact with the surface 144 of the reset button 33. This causes push bar 145 to push the end of the spring member 134*a* down and release the edge 138 of cam actuator 131 from edge 139 so that the edge 138 rotates back over the spring member 134*a* until it strikes the edge 146 of the spring member 134*b*, thereby continuing to hold the contacts 113, 114 open. Then as the reset button 33 is manually released the surface 143 pushes it up releasing edge 138 of cam 131 at edge 146 and allowing cam actuator 131 to move clockwise under the spring pressure of the contact arm 111. The pivoting cam actuator 132 is geared to cam actuator 131 and also moves to the contact closed position.

Figure 5:
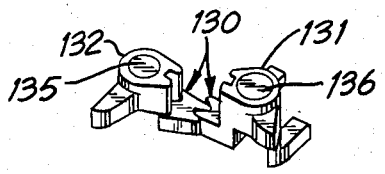
FIG. 5 is an illustration of the cam actuators of the present invention.

This geared relationship is illustrated in FIG. 5. The mating gears 130 (not shown in FIGS. 3 and 4 for purposes of simplicity) are integral parts of cam actuators 131, 132 and coordinate their rotation about the bosses 135, 136. Thus cam actuators 131, 132 exhibit "mirror image" motion to simultaneously open contacts 113, 114. It should be noted that contact forces are isolated from reset forces, and therefore a relatively light and pleasing feel of the reset button 33 results.

Figure 6A:
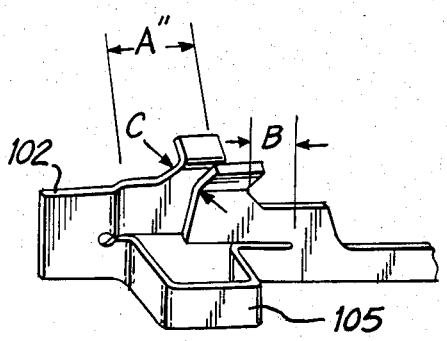
FIGS. 6A and 6B are illustrations of spring arms used to engage a receptacle blade.
Figure 6B:
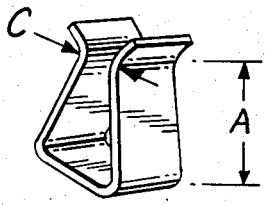
(PRIOR ART) FIG. 6B

A problem with shallow depth receptacles lies in the short distance which is available for flexing the spring arm which engage the plug blade as in the prior art devices of Fig. 6B. In the apparatus of the present invention as illustrated in FIG. 6A this problem is overcome by placing the receptacle spring arms on terminal 102 at right angles to the direction of insertion of the plug blade. This offers the possibility of having a longer blade beam flexing element "A" and permits torsional flexure in region "B" in addition to simple beam flexure. Both of these characteristics permit a relatively uniform response to deflection, and a relatively low stress level within the material for a given developed contact force "C" between the plug blade and the receptacle elements. In addition, this configuration provides a receptacle design which has a continuous electrical path to each side of the blade receiving region of the receptacle, and which localizes deflections during blade insertion to the immediate blade receiving region 105.

Figure 7:
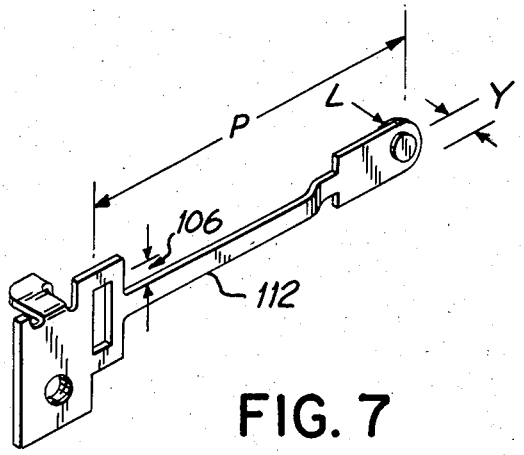
FIG. 7 is an illustration of a flexure arm of the present invention.
Figure 8:
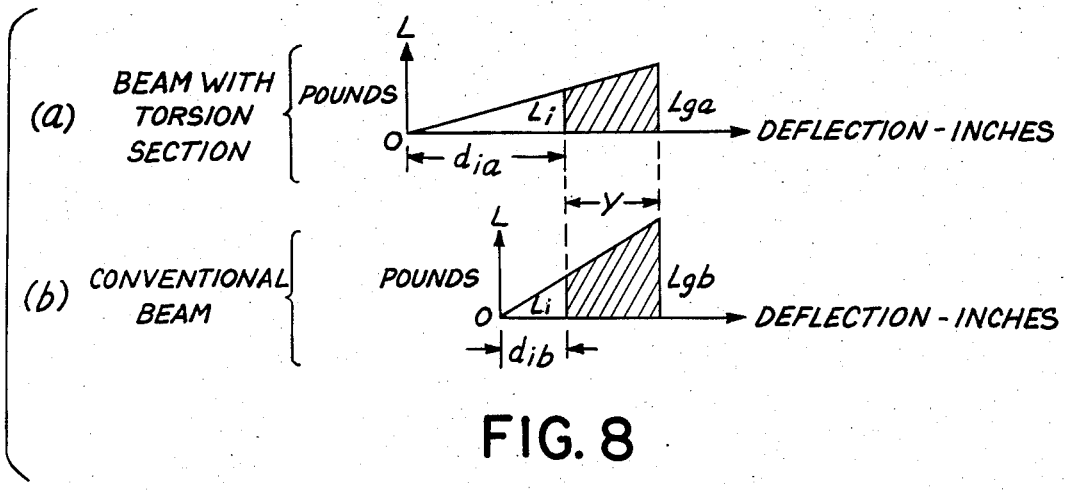
FIG. 8 is a graphical representation of deflection loads exerted upon two different types of beams.

Referring now to FIG. 7, an illustration of the flexure arm 112 is provided. The flexure arm 112 has two torsional sections 106 which in effect add length to the beam member 112. This causes a greater deflection for a given load, in effect softening the beam. FIGS. 8*a*, 8*b* are load deflection plots which further illustrate the operation of the flexure arm 112. FIG. 8*a* describes a plot for a torsion type arm as in FIG. 7, and FIG. 8*b* describes a plot for a conventional beam type arm.

On the two plots $L_i$ is an equal load value representing contact pressure (L in FIG. 7) with the contacts closed. It should be noted that the torsion arm has been deflected (y in FIG. 7) a greater distance $d_{ia}$ (in the FIG. 8*a*) than the conventional beam arm $d_{ib}$ (in FIG. 8*b*) to achieve the initial contact load $L_i$. The contact opening distance y is the same, but the final torsion contact opening load, $L_{ga}$, is less than the final beam opening load, $L_{gb}$, because of the smaller load-deflection slope of FIG. 8*a*. The area under the curve between $L_i$ and $L_{g(a\ or\ b)}$ corresponds to the work done in opening the contacts and it is less for the torsion system of FIG. 8*a*. As a result of this effect the work required to open the contacts is greatly reduced by the use of the torsion member 106.

Figure 9A:
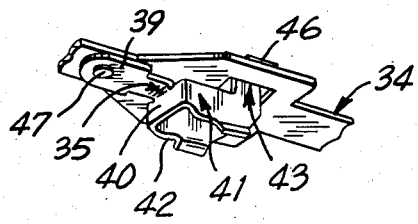
FIGS. 9A and 9B illustrate the ground contact for the apparatus of the present invention.
Figure 9B:
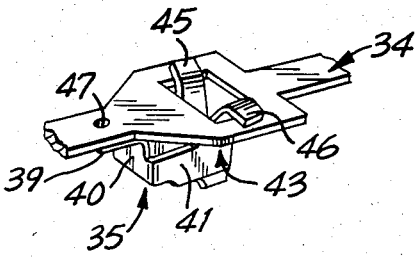

Referring now to FIGS. 9A and 9B top and bottom views of the bifurcated ground contact 35 for the present invention is provided. The mounting strap or yoke 34 is used to mount the entire device in a wall box. The ground contact 35 consists of a mounting tab 39, a cross structure 40, two torsional members 41 and 42, two blade contact members 43 and 44, and two support tabs 45 and 46. There is also a mounting point 47.

The unique features of this design include the torsional members 41, 42 which gives the blade contact members 43, 44 the ability to flex within the mounting strap opening but take no permanent set. Each member 41, 42 acts as a beam and as a torsional member in combined loading and thus gives increased motion without exceeding the yield strength of the material The tabs 45, 46 are trapped between the plastic face cover 23 of the entire device and the yoke 34 and resist the thrusting and withdrawal force of an electrical grounding blade of a three blade plug.

Figure 10:
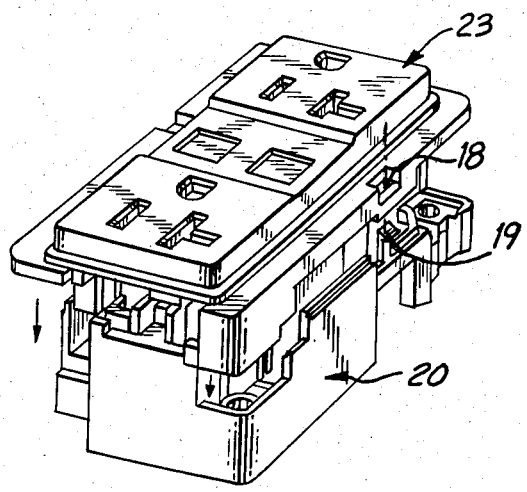
FIG. 10 illustrates snap fingers used to assemble the device of FIG. 1.

Referring now to FIG. 10 an illustration of a snap finger 19 used to secure the face cover 23 to the housing 20 is provided. There are two snap fingers 19, one on each side of housing 20, which cooperate with an aperture 18 in the face plate 23. The two snap fingers 19 hold the face cover 23 closed after all the mechanical parts are assembled into the upper half of the housing 20. This feature makes the assembly process easier and allows the partially assembled device to be turned upside down for assembling the electronic module associated with printed circuit board 70.

Figure 11A:
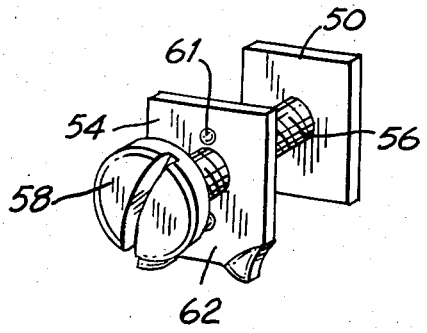
Figure 11B:
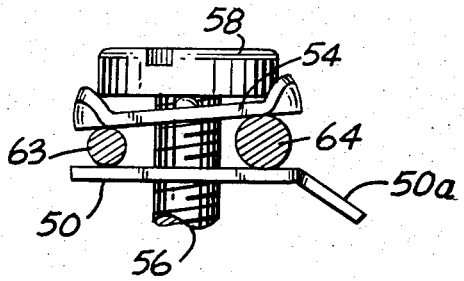

Referring now to Figs. 11A and 11B, the device for securing the supply conducting wires to the apparatus of the present invention is illustrated in two views. An optional pressure pad 54 is designed to be positioned on the terminal screw 56 body between the screw head 58 and the terminal plate 50. The pressure pad 54 has dimples 61, 62 on the top and bottom of the thru hole for pivoting. Pivoting is needed so that two wires 63, 64 of slightly different diameters can be captured securely. This pressure pad 54 can be omitted and screw 56 and terminal plate 50 can act as a normal binding wire attachment system. This same system can be used on the load side wire connections of FIG. 1.

Figure 12A:
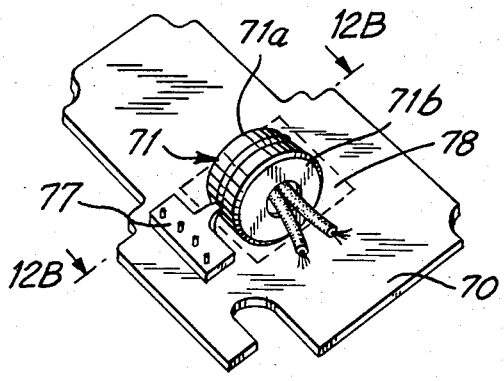
FIGS. 12A and 12B are illustrations of a transformer assembly mounted upon a printed circuit board.
Figure 12B:
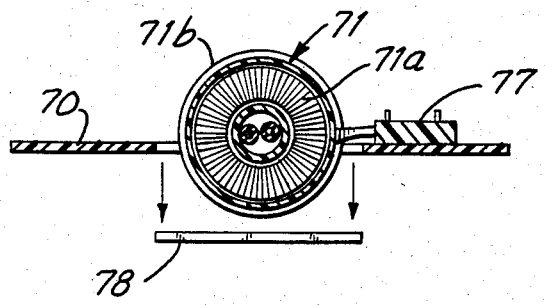

Referring now to FIGS. 12A and 12B illustrations of the transformer assembly 71 are provided. The transformer assembly 71 is comprised of transformers 71*a*, 71*b* which are heat sensitive components, and excessive heat from a wave soldering operation can damage them. In prior art GFCI's, traditionally, the transformer assembly 71 is manually soldered into the printed circuit board after wave soldering the other components. To expedite the assembly of the electronic module on the printed circuit board 70, it is preferred that the transformer assembly 71 be wave soldered into the printed circuit board 70 along with the rest of the components. The transformer assembly 71 includes an arm 77 which permits the assembly to be safely positioned as shown in FIG. 12A during the wave soldering. The perforated popaway window 78 in the printed circuit board 70 under the transformer assembly 71 provides protection during the wave soldering. After the transformer assembly 71 has been soldered, the window 78 is poppedaway and the transformer assembly 71 pushed down to its correct position as illustrated in FIG. 12B.

From the foregoing description, it can be appreciated that the apparatus of the present invention has numerous advantages over prior art GFCI's. These advantages include:

(a) A shallow depth of housing 20 improves room in flush outlet boxes for wiring. The forward mounting position of the solenoid coil 150 and compact contact opening mechanism permit such a shallow depth.

(b) The use of screw terminals of FIG. 11 to make replacement of a standard receptacle (in retrofit situations) easier.

(c) The use of separate line contact arm 112 and neutral contact arm 113 permits individual control of contact pressures in production.

(d) The use of a mechanically efficient coordinated split actuating mechanism 131, 132, 133 permits variation of sequence of opening and distance of opening of the line and neutral contacts 113, 114 and reduces power required for opening.

(e) The elimination of a secondary or intermediate contact support mechanism simplifies mechanism and thereby improve operating reliability of the device. The solenoid 150 directly opens the contacts 113, 114.

(f) The elimination of a secondary contact support mechanism simplifies quality control requirements in production. Separation of contact and reset forces permits lighter push-button force on the reset button 33 and variations of one force without affecting the other.

(g) Other designs utilize a spring to provide power to open the contacts. The apparatus of the present invention utilizes the major source of power, the solenoid coil 150 to provide this function. Thus, if contacts 113, 114 become welded shut maximum power is available to open them.

(h) A hindrance in utilizing the solenoid core motion to open the power contacts lies in the fact that the solenoid supply system ceases to receive power when the solenoid core opens the main power contacts. This is overcome in the present invention by utilizing a period of free travel for the solenoid core 150 before it touches the contact opening mechanism 131, 132, 133 and thereby opens the power supply. The free travel builds up kinetic energy.

(i) A problem of some GFCI's is that the manual reset operation, after the unit has tripped and the contacts have opened, permits "teasing" of the load contacts. "Teasing" here means removing some of the normal contact pressure. This can be done at any time the GFCI power contacts are set. "Teasing" of the contacts causes arcing and can erode the contact surface. In the apparatus of the present invention the reset device of FIG. 4 cannot open the contacts 113, 114 and therefore cannot "tease" them.

While the invention has been described in its preferred embodiments it is to be understood that the words which have been used are words of description rather than limitation and that changes may be made within the purview of the appended claims without departing from the true scope and spirit of the invention in its broader aspects.

What is claimed:

1. A ground fault circuit interrupter in a power distribution system comprising:

an electromagnetic coil means having a moveable core;

at least two pivot arms that rotate in response to the linear movement of the moveable core of said electromagnetic coil means;

at least two pairs of contacts, one contact of each pair stationary and the other contact of each pair being disposed on a deflectable flexure arm, each of said deflectable flexure arms being responsive to the rotation of one of said pivot arms, said deflectable flexure arms normally biasing said contacts in a closed position;

means for detecting the occurrence of a fault in said power distribution system in order to actuate said electromagnetic coil means, such that said pivot arms rotate, thereby causing said deflectable flexure arms to separate said contacts and interrupt the flow of current.

2. A ground fault circuit interrupter according to claim 1 wherein said pivot arms are coupled together by a catcher which cooperates with the moveable core of said electromagnetic coil means.

3. A ground fault circuit interrupter according to claim 2 wherein said flexure arms include torsion elements which increase the effective length of said flexure arms.

4. A ground fault circuit interrupter according to claim 1 which further includes load terminals electrically coupled to said flexure arms and including two receptacle spring arms disposed at right angle to the insertion of a plug blade.

5. A ground fault circuit interrupter according to claim 1 which further includes a mounting strap with an aperture therein and a bifurcated ground contact disposed in said aperture and comprised of a mounting tab, a cross structure, and means for contacting the ground blade of a plug.

6. A ground fault circuit interrupter according to claim 5 wherein said means for contacting the ground blade of a plug includes a pair of torsional members connected to said cross structure, a blade contact member connected to each of said torsional members and a support tab connected to each of said blade contact members.

7. A ground fault circuit interrupter according to claim 1 which further includes a housing and a face plate, said housing including at least one snap finger which cooperates with an aperture in said face plate.

8. A ground fault circuit interrupter according to claim 1 which further includes a terminal means for coupling electrical energy to said contacts, said terminal means including a terminal having a threaded aperture and a cooperating screw with a pressure pad disposed upon said screw.

9. A ground fault circuit interrupter according to claim 8 wherein said presure pad includes a pair of dimples which interface with said screw head.

10. A ground fault circuit interrupter according to claim 1 wherein said means for detecting the occurrence of a fault includes a plurality of transformers which are coupled to a printed circuit board having a popaway aperture.

11. A ground fault circuit interrupter in a power distribution system comprising:

an electromagnetic coil means having a moveable core;

at least two pairs of contacts, one contact of each pair being stationary and the other contact of each pair being disposed on a deflectable member, said deflectable members normally biasing said contacts in a closed position;

means for applying the operating force of said electromagnetic coil means to directly open said contacts by moving said deflectable members; and means for detecting the occurrence of a ground fault in said power distribution system in order to actuate said electromagnetic coil means.

12. A ground fault circuit interrupter according to claim 11 which further includes resetting means for preventing said contacts from being teased when said contacts are closed.

13. A ground fault circuit interrupter in a power distribution system comprising:

an electromagnetic coil means having a moveable core;

at least two pivot arms that rotate in response to the linear movement of the moveable core of said electromagnetic coil means, said pivot arms being coupled together by a catcher that cooperates with the moveable core of said electromagnetic coil means;

at least two pairs of contacts, one contact of each pair being stationary and the other contact of each pair being disposed on a deflectable flexure arm, each of said deflectable flexure arms being responsive to the rotation of one of said pivot arms, said flexure arms including torsion elements that increase the effective length of said flexure arms, each of said flexure arms having a relatively narrow section and a relatively wide section and said torsion elements being formed by an aperture in said relatively wide section of said flexure arm; and means for detecting the occurrence of a fault in said power distrubution system in order to actuate said electromagnetic coil means, such that said pivot arms rotate, thereby causing said deflectable flexure arms to separate said contacts and interrupt the flow of current.

14. A ground fault circuit interrupter according to claim 13 which further includes a latching mechanism for holding said contacts open when said flexure arms are deflected.

15. A ground fault circuit interrupter according to claim 14 wherein said latching mechanism includes a two member spring responsive to one of said pivoting arms.

16. A ground fault circuit interrupter according to claim 15 which further includes a reset button operable to release said latching mechanism thereby allowing said contacts to close after the fault has been cleared.

17. A ground fault circuit interrupter according to claim 16 wherein one of said pivot arms includes an extension which cooperates with said two member spring.

18. A ground fault circuit interrupter according to claim 17 wherein one of said pivot arms further includes a surface which cooperates with a surface of said reset button.

19. A ground fault circuit interrupter according to claim 18 wherein said pivot arms include mating gears.

* * * * *